United States Patent [19]

Lynch et al.

[11] 4,107,464

[45] Aug. 15, 1978

[54] ALARM COMMUNICATIONS SYSTEM

[76] Inventors: John H. Lynch, 501 Amethyst St., New Orleans, La. 70124; George L. Gallegos, 513 Harang, Metairie, La. 70001

[21] Appl. No.: 819,089

[22] Filed: Jul. 26, 1977

Related U.S. Application Data

[63] Continuation of Ser. No. 608,238, Aug. 27, 1975, abandoned.

[51] Int. Cl.[2] ..... H04R 27/00

[52] U.S. Cl. ..... 179/1 B; 179/5 P; 340/310 R; 340/692

[58] Field of Search ..... 179/1 B, 5 P, 1 SW; 340/221, 310 R, 420

[56] References Cited

U.S. PATENT DOCUMENTS

| | | | |
|---|---|---|---|
| 3,388,390 | 6/1968 | Ciaschi | 340/221 |
| 3,626,097 | 12/1971 | Bloom | 179/1 B |
| 3,795,769 | 3/1974 | Nowka et al. | 179/1 SW |
| 3,798,672 | 3/1974 | Gregg | 340/221 |

*Primary Examiner*—Thomas W. Brown
*Assistant Examiner*—E. S. Kemeny
*Attorney, Agent, or Firm*—James B. Lake, Jr.

[57] ABSTRACT

An alarm communication system including a circuit for normally transmitting music to a plurality of different locations within a building which includes a source of music, a plurality of speakers selectively positioned throughout the building and a normally closed switch for connecting the source of music to each of the speakers. A source of programmed alarm announcements stored on a tape is converted to an electrical signal, amplified and coupled to each of the speakers via an override switch. Actuation of an override switch in response to the occurrence of an emergency condition, such as a fire, causes the normally closed switch to open and couples the electronic signal corresponding to the programmed alarm announcements to each of the speakers. A microphone is provided which is selectively actuatable upon the closing of a switch to couple instantaneous voice communications to each of the aforementioned speakers while at the same time inhibiting the programmed alarm announcements being coupled thereto. A handset selectively monitors the programmed alarm announcements from a centralized location to insure that appropriate announcements are being coupled to each of the aforementioned speakers.

1 Claim, 5 Drawing Figures

ALARM COMMUNICATIONS SYSTEM

This is a continuation of application Ser. No. 608,238, filed Aug. 27, 1975, now abandoned.

BACKGROUND OF THE INVENTION

This invention relates to an alarm communication system and more specifically relates to an emergency warning system for high-rise office buildings and the like, wherein provision is made for permitting ad hoc voice communication to selected areas of the building.

In the past, in traditional alarm systems for warning occupants of fires and other emergencies, a person actuated a break-glass or pull-station alarm with the result that an alarm was generated without qualification as to the type of emergency or the extent of the emergency. Thus, the nature of the emergency in a traditional system was completely unknown, and no other means other than standard existing communication paths such as telephones and personal communication could be utilized to determine to what extent and where an emergency existed. These standard communication paths often were not operational because of smoke or fire which cut off the paths.

In alarm systems utilizing coded bells and other symbolic warning devices, training and conditioning of the occupants of the building was required in order for the occupants to recognize the alarm. As the system complexity increased to include increased number of coded alarms, proportionally more rigorous training was required of the occupants of the building. Accordingly for high-rise office buildings wherein there is a substantial changeover of occupancy, these systems became less reliable.

In response to the aforementioned drawbacks to the prior art, applicants provided an emergency alarm system for high-rise office buildings wherein the emergency alarm system was coupled to a system for transmitting music to a plurality of different areas throughout the building. Under normal operating contions, when no alarm was sounded, the music was transmitted through a normally closed relay switch to an amplifier, the output of which was coupled to speakers positioned throughout the building. When an alarm switch position in the area of the emergency conditions was closed to indicate an emergency condition, the normally closed music transmitting switch was opened and the output of a tape recorder was coupled to each of the speakers via an override switch. The override switch had the dual function of causing the normally closed music transmitting switch to open and to connect the output of the tape recorder to the speakers position throughout the building. In addition to the speakers which were positioned in various areas of the building, an additional number of speakers were positioned in the stairwell, the elevators and in the elevator foyers of the building. The output of the tapes was coupled to these extra speakers. A remote control switch was provided at a centralized location for causing an alarm indication to occur even when none of the alarm switches were closed. The purpose for this switch was to initiate an alarm if no one was available to actuate an alarm switch and in addition permitted the testing of the alarm system without actuating any of the alarm switches. This system, however, had a drawback in that no means were provided to enable human judgment announcements whenever required in order to channel the occupants of the buildings through selected exits, to advise the occupants of changing emergency conditions as the conditions changed, and to override the alarm system, should the emergency be terminated or the alarm found to be false.

In view of the aforementioned, it is an object of the present invention to provide an improved alarm communication system.

It is another object of this invention to provide an improved alarm communication system having means for providing human judgment announcements to the occupants of a building on a selective basis.

SHORT STATEMENT OF THE INVENTION

Accordingly, the present invention relates to an alarm communication system comprising a means for transmitting music to a plurality of different locations within a building, which means includes a source of music, a plurality of speakers positioned at selective locations throughout the building, and a normally closed switching means which connects the source of music to the speakers. A source of programmed alarm announcements stored, for example, on tapes is provided which announcements are connected to speakers located in the selected work areas, in the stairwells, the elevators and other important locations of the building by means of an override switch. The override switch is closed whenever an emergency exists and causes the normally closed music connecting switch to open while at the same time connecting the output of a tape recorder to the speakers. A microphone is provided, together with a second override switch for interrupting the programmed alarm announcements and for permitting human judgment announcements to be coupled to each of the aforementioned speakers to advise the occupants of the building of changes in the emergency condition. A monitoring means in the form of a handset is provided for monitoring the programmed alarm announcements to determine that the proper announcement is being transmitted through the building. The system is provided in a console in a selected centrally located area so that the system can be operated and controlled by a single person.

BRIEF DESCRIPTION OF THE DRAWINGS

The invention will become more fully apparent from the following detailed description of the preferred embodiment, the appended claims and the accompanying drawings in which:

DETAILED DESCRIPTION OF THE PREFERRED EMBODIMENT

Figure 1:
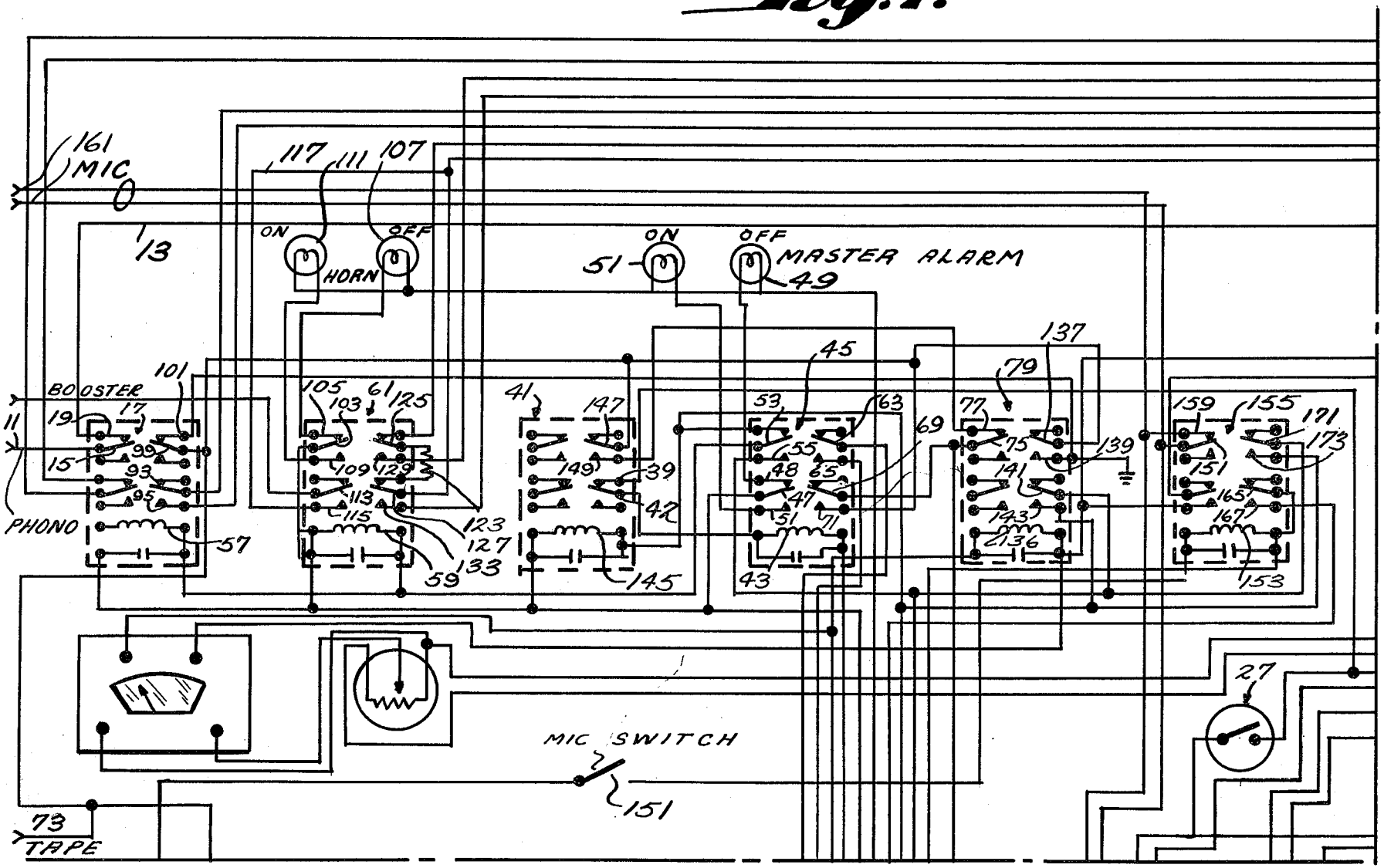
FIG. 1 is a partial schematic drawing of the preferred embodiment of the alarm communication system of the present invention.
Figure 2:
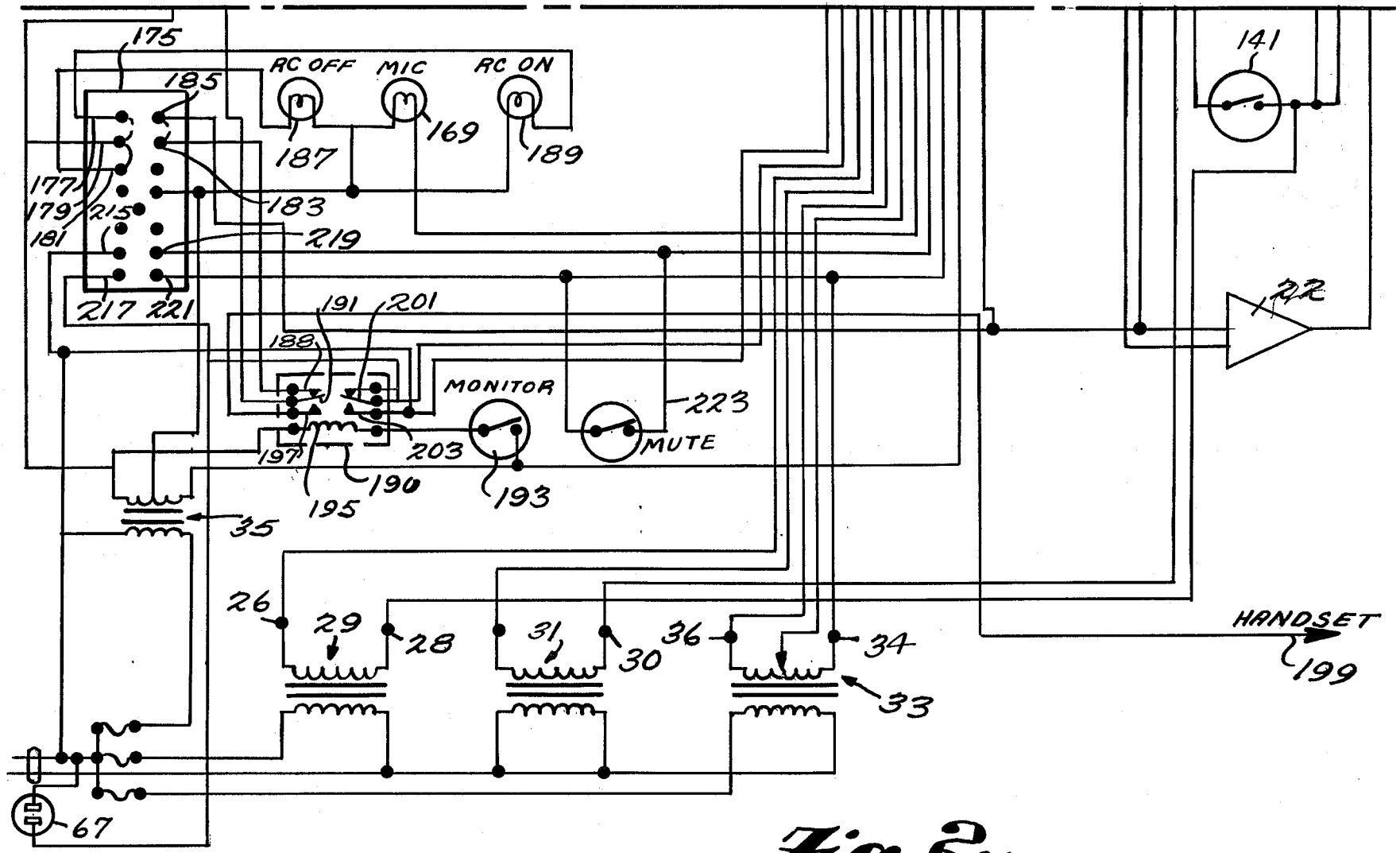
FIG. 2 is a partial schematic drawing of the preferred embodiment of the alarm communication system of the present invention.
Figures 3, 4:
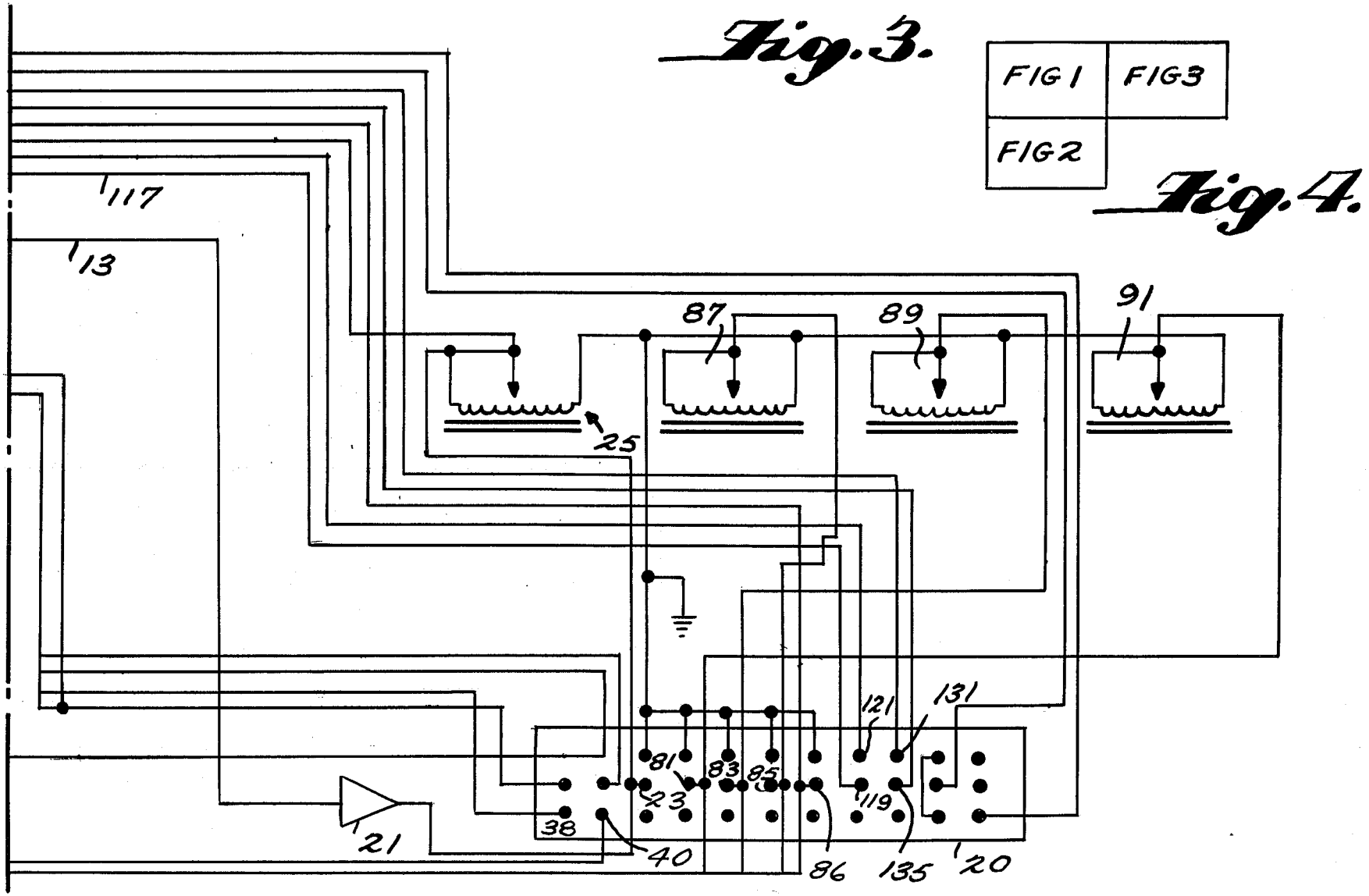
FIG. 3 is a partial schematic illustration of the preferred embodiment of the alarm communication system of the present invention.
FIG. 4 is a block diagram showing the relative positions of FIGS. 1, 2 and 3.
Figure 5:
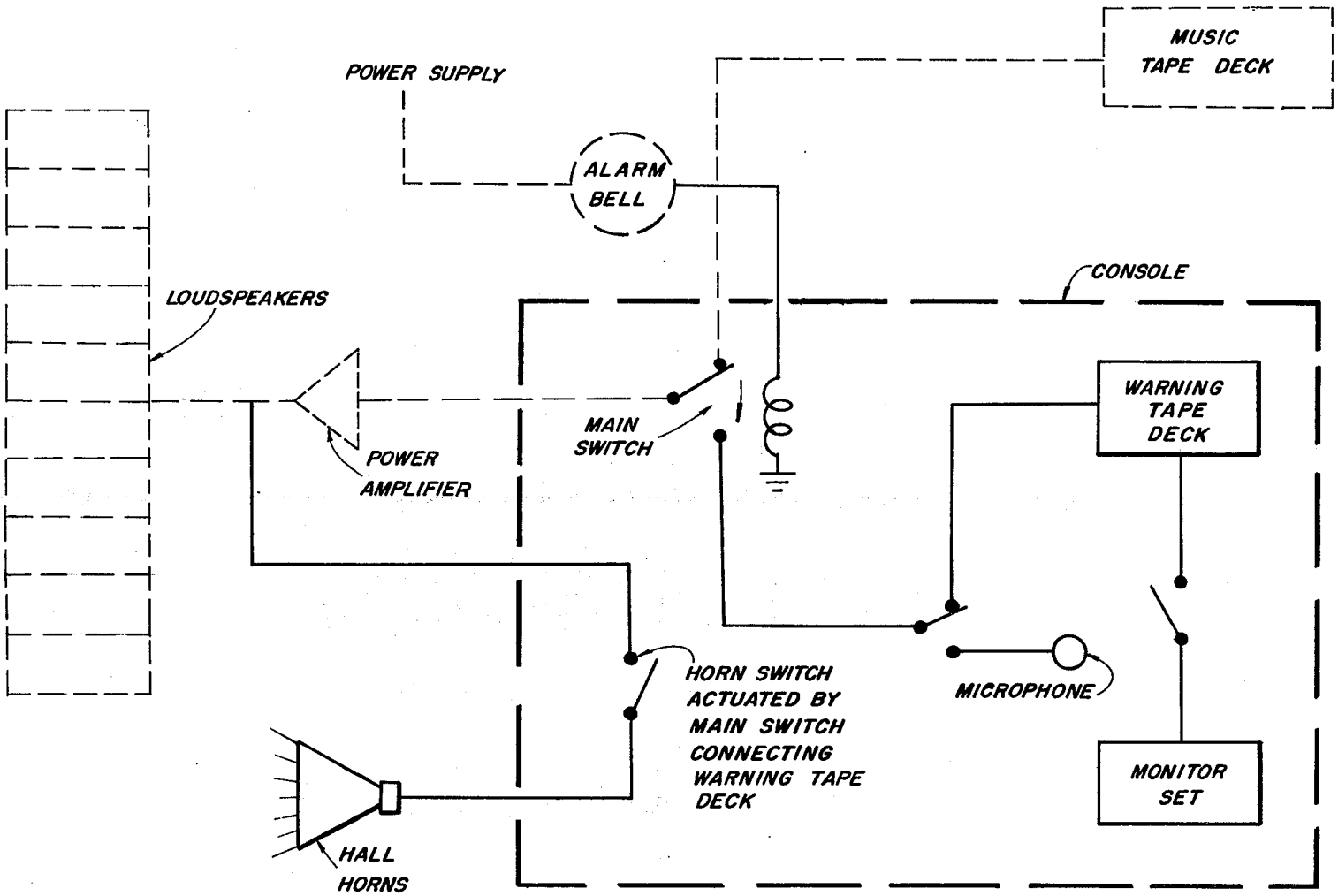
FIG. 5 is a simplified block diagram of the invention.

Refer now to FIGS. 1–3 where there is disclosed the preferred embodiment of the alarm communication system of the present invention. Under normal conditions when no emergency exists, an electronic signal corresponding to music from a suitable source (not shown) is coupled to the phono input 11 of the alarm communication system of the present invention. The input 11 is connected to switch arm 15 of relay 17. Switch arm 15 is normally in contact with terminal 19 of relay 17 which terminal is connected to the input of audio power amplifier 21 via conductor 13. The output of audio amplifier 21 is connected to output terminal 23 of the audio alarm system which output is, in the preferred embodiment, connected to a plurality of speakers selectively positioned throughout, for example, a high-rise office building, to provide music to the occupants therein. The level of the output signal at terminal 23 is selectively controlled manually by means of an attenuator 25.

It should be understood that the amplifier 21 may be positioned such that its input is connected to terminal 23 in which case conductor 13 would be connected directly to terminal 23. The output of the amplifier 21 would then be connected to the selectively positioned speakers. It should also be understood that the alarm communication system of the present invention can be operated without a central music system.

As illustrated in FIG. 2, a source of voltage such as a conventional 117 volt house voltage is coupled to each of three transformers 29, 31 and 33, in order to convert the voltage, at the secondary thereof to, for example 6.3 volts. These voltages are utilized to operate the relays and lamps in a manner to be explained more fully hereinbelow. A fourth transformer 35 is provided for operating a monitoring handset and a microphone system as will also be disclosed more fully hereinbelow.

Operationally, when an emergency condition such as a fire exists, a master control switch 27 are closed, thereby coupling a voltage from the terminal 30 of the transformer 31 through the master control switch 27 to contact terminal 39 of relay 41. It should be understood that master alarm switches similar to alarm switch 27 are positioned throughout the various floors of the high-rise building in which the alarm communication system is positioned. Accordingly, if an alarm switch in a different location is closed, the voltage from the terminal 30 is communicated to the contact terminal 39 via the closed alarm switch which is connected across conducting lines extending from terminals 38 and 40 of the output terminal panel 20. With power coupled to terminal 39, current is conducted through contact arm 42 to the energizing coil 43 of relay 45. Thus, relay 45 becomes energized thereby throwing each of the switch arms illustrated therein to the position opposite that illustrated in the figures. For example, with switch arm 47 closed on terminal 48 as illustrated, energy from the center tap of transformer 33 is coupled to the off-lamp 49 via switch arm 47 and then back to the secondary of transformer 33 to thereby normally energize the off-lamp 49 to give an indication that the master alarm switches 27 are off. With relay 45 energized, switch arm 47 closes on contact 51 to thereby de-energize lamp 49 and energize alarm switch on lamp 51. At the same time switch arm 53 is closed on contact 55 to thereby cause current to flow from terminal 34 of transformer 33 through contact arm 53 and contact 55 to one side of the energizing windings 57 and 59 of relays 17 and 61, respectively. Energization of relay 45 also causes contact arm 63 to close on contact terminal 65 to thereby cause the 117 volt input to the system to be connected across outlet 67, which outlet provides energy to a tape recorder system which will be explained more fully hereinbelow. Finally, energization of relay 45 causes contact arm 69 to close on contact 71. Accordingly, the input to the system from the output of a tape recorder at terminal 73 is coupled to an output power amplifier 22 via contact arm 75 and contact terminal 77 of relay 79. The output of power amplifier 22 is coupled to terminals 23, 81, 83, 85 and 86 of the output of the system. As aforementioned, output terminal 23 is connected to speakers positioned in selective locations throughout the building where the occupants of the building normally work or reside. The output terminal 81 is connected to speakers which are positioned in the stairwell or stairwells of the building. Terminal 83 is connected to speakers positioned in elevators throughout the building and output terminal 85 is connected to speakers located in the elevator foyers of the building. Terminal 86 is connected to speakers positioned in areas to which only emergency information from the tape or microphone of the present system is coupled. Attenuating transformers 25, 87, 89 and 91 are provided so that the volume of the signal coupled to the respective speakers can be manually controlled from the central console unit.

It should be understood that if music signals are normally coupled to speakers in the elevators, stairwells and elevator foyers, only one amplifier 21 will be necessary. In this case the tape input terminal 73 is connected to the input of amplifier 21 with the output thereof connected to terminals 81, 83, 85 and 86. It can be seen that the output of the amplifiers will not be coupled to the emergency speakers connected to terminal 86 until relay 17 is energized. As will be seen, relay 17 is energized only upon the closure of master alarm switch 27 or remote control switch 175.

As aforementioned, when contact arm 53 closes on terminal 55 of relay 45, relays 17 and 61 are energized. When relay 17 is energized, contact arm 15 is switched away from terminal 19, thereby opening the current path from the music input 11 to the amplifier 21. At the same time, switch arm 93 makes contact with terminal 95, thereby connecting the outputs of amplifiers 21 and 22, which as aforementioned may be embodied in a single unit, to output terminal 86. As aforementioned, output terminal 86 is connected to emergency alarm speakers located at strategic places throughout the building to which music is not normally coupled. Finally, switch arm 99 is rotated away from terminal 101 which is at ground potential. Thus, with switch arm 99 no longer at ground potential, the input to amplifier 22 is no longer grounded so that the system provides an output signal from the tape recorder to the speakers via relay 45 which signal is preprogrammed as desired.

As aforementioned, when relay 45 is energized, relay 61 is energized. Before relay 61 is energized, contact arm 103 makes contact with terminal 105. Thus, horn OFF lamp 107 is energized. However, when relay 61 is energized, contact arm 103 makes contact with terminal 109, thereby de-energizing lamp 107 and energizing horn ON lamp 11. At the same time, switch arm 113 is closed on terminal 115. Thus, the output of a booster amplifier, which may be required if extra speakers are utilized, is connected to the booster output line 117. Booster output line 117 is connected to terminal 119 of the output panel 20 of the alarm communication system. Terminal 119 is electrically connected to one side of each of a plurality of speakers while output terminal 121 is connected to the other side thereof. Terminal 121 is at a reference potential such as ground. Terminals 119 and 121 across which the output of the booster amplifier is connected have a power dissipating 350 ohm, 10 watt resistor 123 connected thereacross via contact arm 125 and contact arm 127. When, however, the relay 61 is energized, contact arm 125 is rotated into contact with terminal 129 to thereby connect terminals 121 and 131 together. At the same time rotation of contact arm 127 into contact with terminal 133 causes terminals 119 and 135 to be connected together so that the booster is connected directly to the speakers. Thus, during normal operation of the system when no emergency exists, the output of the booster amplifier is dissipated by resistor 123. However, when relay 61 is energized upon the occurrence of an emergency, the booster amplifier is connected directly across the terminals of the speakers.

When, for example, it is desired to break into the pre-programmed message being conveyed to the various speakers throughout the building, microphone switch 141 is closed, thereby connecting output terminal 28 of transformer 29 to solenoid 136 of relay 79. The other side of the solenoid 135 is connected to the output 26 of the transformer 29. With relay 79 thus energized, contact arm 137 rotates into contact with terminal 139 which terminal is at ground potential. Thus, the output of the tape recorder is grounded so that the tape signal is effectively muted. In addition, contact arm 141 is rotated into contact with terminal 143 to thereby couple the voltage at output terminal 34 of the transformer 33 to the solenoid 145 of relay 41. The other side of the solenoid 145 is connected to terminal 36 of transformer 33 and accordingly relay 41 is energized. With relay 41 energized, relay 45 is deenergized since contact arm 42 is rotated away from terminal 39. At the same time, contact arm 147 rotates into contact with terminal 149. However, since contact arm 75 no longer is in contact with terminal 77 because relay 79 is energized, the tape input will not be connected to the amplifier 22 and accordingly, the tape output continues to be effectively muted.

When it is desired to use the microphone to provide a human judgment announcement, microphone switch 151 is closed, thereby connecting the secondary of transformer 35 across the solenoid 153 of relay 155. With the microphone relay 155 thus energized, contact arm 157 is rotated away from terminal 159 and accordingly, the input from a microphone to terminals 161 is no longer short-circuited so that the signal coupled to terminals 161 is coupled to the speakers throughout the building via power amplifier 22. At the same time switch arm 165 is rotated into contact with terminal 167 so that the centertap of the secondary of transformer 35 and another output terminal of the secondary winding are connected across the microphone ON signal lamp 169 which is on the front of the console. In addition, contact arm 171 rotates into contact with terminal 173 to thereby connect the output of the secondary of transformer 33 across the solenoid 145 of relay 41 to insure that the output of the tape recorder is muted during the time interval when the microphone is being utilized. This feature of applicants' invention has the advantage that during the course of an emergency, as the emergency conditions change the occupants of a building can be continuously updated and apprised of occurring events so that evacuation of the building can proceed efficiently and with the greatest possible speed.

In order to provide control of the alarm system from a centralized location, a remote control switch 175, shown in FIG. 2, which is normally in a state such that terminals 179 and 181 are normally closed on one another and that the remaining terminals are open. In this state, the voltage from the center tap and one output terminal of the secondary of transformer 35 are connected across the remote control OFF lamp 187. However, when the remote control switch is turned on, the contact between terminals 179 and 181 is opened and contact between terminals 177 and 179 is closed. Accordingly, remote control OFF lamp 187 is de-energized while remote control ON lamp 189 is turned on. At the same time, terminals 183 and 185 are connected together. With terminals 183 and 185 connected together, the output of the tape recorder which is coupled to input terminal 73 is conducted through terminals 183 and 185 to contact terminal 188 of relay 190. Contact arm 191 of relay 190 is in contact with terminal 188 and accordingly, the output of the recorder is coupled to amplifier 22 for amplification thereby with the output of amplifier 22, as aforementioned, being coupled to the speakers throughout the building. At the same time contact terminals 215 and 217 are closed upon one another to energize the tape recorder. In addition, terminals 219 and 221 are closed thereby connecting terminal 34 of the secondary of transformer 33 to solenoid 145 of relay 41 and to solenoids 57 and 59 of relays 17 and 61, respectively, through contacts 53 and 55 of relay 45. Thus relay 17 is energized to remove the ground from the tape input and to disconnect the music to the speakers. In addition, relay 61 is energized to connect the booster amplifier in circuit with the additional speakers. Finally, relay 41 is energized to connect terminals 147 and 149 together. Thus a second path for the tape input signal is provided through contacts 147 and 149 and contacts 75 and 77 of relay 79 to the amplifier 27. Accordingly, it can be seen that the remote control switch in effect initiates operation of the system even when one of the mast control switches 27 positioned throughout the building is not actuated.

It may be desirable during the course of operation of this system to monitor the tape output. This can be achieved without interrupting the operation of the system by closing monitor switch 193 which connects the solenoid 195 of the relay 190 across the output terminals of the secondary of transformer 35. Thus relay 190 is energized so that contact arm 191 breaks contact with terminal 188 and makes contact with terminal 197. Thus, one circuit path from the tape recorder input terminal 73 to the amplifier 22 is broken and instead the input from the tape recorder is coupled via contact arm 191 and terminal 197 to a handset terminal 199. The handset may be of any typical design such as that provided in a conventional telephone handset and permits the operator to listen in on the tape to make certain that the tape is providing the correct instructions.

Assuming that the remote control switch and none of the master alarm switches 27 are actuated, the tape announcements can still be monitored without interfering with the normal operation of the system by closing monitoring switch 193. As aforementioned, the output of the tape recorder is then coupled to the handset output terminal 199 via relay 190. However, the tape output will not be coupled to the speakers since none of the relays 17, 61 or 41 will be energized. Power to the tape recorder is provided by the closure of contact arm 201 on terminal 203 thereby connecting 117 volts across outlet 67.

A voltage meter 205 is provided which is energized by the voltage across relay solenoid 135 of relay 79 when the microphone is being utilized. The input to the voltage meter 205 is calibrated by means of a variable resistor 207 with the input to the variable resistor 207 being derived from terminals 209 and 211 of the terminal board 20. These terminals 209 and 211 may be connected across any one of the desired output terminals to provide an indication of the volume of the signal being coupled to the respective speaker locations, which volume can then be adjusted by appropriately manually adjusting the attenuating transformers 25, 87, 89 and 91.

The improvement of the present invention which provides for the breaking in of a pre-programmed taped announcement by means of a microphone input for the purpose of making human judgment announcements renders the present alarm communications system substantially more flexible than that provided by the prior art. In addition, the utilization of circuitry for automatically disconnecting a music input to the various speakers throughout a building and connecting in lieu thereof pre-programmed taped announcements on an automatic basis once a master alarm switch or a remote control switch is operated substantially simplifies and speeds up the alarm communication procedure over that of the prior art.

While the present invention has been disclosed in connection with a preferred embodiment thereof, it should be understood that there may be other embodiments which fall within the spirit and scope of the invention as defined by the appended claims.

What is claimed is:

1. An alarm system for a high-rise building having a pre-installed non-verbal fire alarm system with at least one master alarm switch, and a pre-installed music transmitting system which includes a music source, amplifier and a plurality of loudspeakers, whereby the alarm system can be simply and conveniently installed to incorporate the pre-installed systems, the alarm system comprising:

(A) a console means comprising a tape unit with recorder-playback means with pre-recorded alarm verbal messages, a microphone, a monitor for the tape unit, a plurality of switching means comprising manual and relay means for operationally modifying modes of said alarm system, a plurality of terminals for convenient interconnection between console means and other components of said alarm system, and a plurality of lamps for indicating operating mode, (B) emergency alarm speakers or horns located at strategic places throughout the building to which music is not normally coupled, and (C) A remote alarm switch for manual alarm instigation, wherein said plurality of switching means comprise: a first relay which provides connection of the music source to the amplifier and loudspeakers in the non-alarm mode; a second relay which responds to the master alarm switch to cause a third relay to interconnect the tape unit to the amplifier and loudspeakers; a fourth relay which responds to the remote alarm switch to interconnect the tape unit to the amplifier and loudspeakers; a fifth relay which responds to a microphone switch to connect the microphone to the amplifier and loudspeakers; a sixth relay which energizes the tape unit, and a seventh relay which responds to a horn switch to connect the horn speakers and lamp indicators to their respective energy sources.

* * * * *